US006622537B2

(12) United States Patent
Rodriguez

(10) Patent No.: US 6,622,537 B2
(45) Date of Patent: Sep. 23, 2003

(54) DEADBOLT WITH LED AND WIRING HARNESS

(75) Inventor: Lawrence G. Rodriguez, Anaheim, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 09/906,228

(22) Filed: Jul. 16, 2001

(65) Prior Publication Data

US 2003/0010075 A1 Jan. 16, 2003

(51) Int. Cl.[7] ..... E05B 15/08; E05B 41/00

(52) U.S. Cl. ..... 70/432; 70/454; 70/461; 70/462; 70/466; 362/100

(58) Field of Search ..... 70/432, 454, 441, 70/DIG. 51, DIG. 59, DIG. 49, 461, 462, 466; 362/80, 100

(56) References Cited

U.S. PATENT DOCUMENTS

| | | | | |
|---|---|---|---|---|
| 1,128,307 A | * | 2/1915 | Greely | |
| 1,358,926 A | * | 11/1920 | Bates | |
| 2,005,274 A | * | 6/1935 | Taylor | |
| 2,049,658 A | * | 8/1936 | Moore | |
| 2,914,656 A | * | 11/1959 | Keith | |
| 3,382,316 A | | 5/1968 | Weiner | |
| 3,719,821 A | * | 3/1973 | Foreman | 70/431 X |
| 3,828,340 A | | 8/1974 | Bauer, Jr. et al. | 340/276 |
| 4,196,422 A | * | 4/1980 | Swigert et al. | 340/542 |
| 4,234,909 A | * | 11/1980 | Cotroneo | 362/100 |
| 4,493,018 A | | 1/1985 | Hopmayer et al. | 363/145 |
| 4,683,741 A | | 8/1987 | Fields | 70/432 |
| 4,760,380 A | | 7/1988 | Quenneville et al. | 70/441 X |
| 4,888,453 A | | 12/1989 | Blasko | 174/135 |
| 4,965,478 A | | 10/1990 | Kobayashi et al. | 310/249 |
| 5,057,975 A | * | 10/1991 | Evigan | 362/100 |
| 5,111,007 A | | 5/1992 | Miller et al. | 200/43.08 |
| 5,153,816 A | | 10/1992 | Griffin | 361/393 |
| 5,611,226 A | * | 3/1997 | Fata | 70/454 |
| 5,712,626 A | | 1/1998 | Andreou et al. | 70/216 X |
| 5,996,383 A | * | 12/1999 | Adelmeyer et al. | 70/454 |
| 6,000,609 A | | 12/1999 | Gokcebay et al. | 235/382 |
| 6,305,814 B1 | * | 10/2001 | Giamas | 362/100 |
| 6,363,763 B1 | * | 4/2002 | Geringer et al. | 70/432 |

FOREIGN PATENT DOCUMENTS

| | | | | |
|---|---|---|---|---|
| GB | 1588720 | * | 4/1981 | 362/100 |

* cited by examiner

*Primary Examiner*—Lloyd A. Gall
(74) *Attorney, Agent, or Firm*—Richard J. Veltman; John D. Del Ponti

(57) ABSTRACT

A lighted deadbolt according to the present invention includes a lock cylinder and a cylinder guard, a light assembly including a light source, a wiring harness including a plurality of wires electrically connected to the light source, and an annular adapter. The adapter includes a housing for receiving the light source and an annular channel for guiding the plurality of wires from the light source. The annular adapter includes a first surface, a wall extending orthogonally from the first surface, and a first plurality of tabs extending from the first surface generally parallel to the wall. The plurality of wires are operatively disposed between the first plurality of tabs and the wall. The adapter further includes a pair of fingers extending from the surface for receiving a sound producing device and a second plurality of tabs extending from the wall. The plurality of wires electrically couple the light source to the sound producing device. The second plurality of tabs are configured to engage the cylinder guard.

14 Claims, 2 Drawing Sheets

DEADBOLT WITH LED AND WIRING HARNESS

The present invention relates to deadbolts in general and lighted deadbolts in particular. More particularly, it relates to lighted deadbolts having an LED to indicate a locked/unlocked status.

BACKGROUND OF THE INVENTION

Lighted deadbolts are known and have been used for some number of years. Typically, they include a lock cylinder, a cylinder guard, a dress cover for the guard, a metal stamping, and a light source, typically an LED, with its associated wiring harness. Unfortunately, existing lighted deadbolt designs require the light source and its wiring harness be mounted to one side of the metal stamping, a protective cover installed to cover a portion of the wiring circuit, and a retainer mounted to the other side of the stamping and coupled to the wiring harness through the stamping. Then the entire light source/wiring harness/stamping assembly must be fitted into the cylinder guard and dress cover. Thus, the manufacturing process requires multiple steps and multiple pieces to be fitted together. Therefore, a need exists for a light source and wiring harness that uses fewer parts and can be installed directly onto the cylinder guard to reduce the number of manufacturing steps.

SUMMARY OF THE INVENTION

A lighted deadbolt according to the present invention includes a lock cylinder and a cylinder guard, a light assembly including a light source, a wiring harness including a plurality of wires electrically connected to the light source, and an annular adapter. The adapter includes a housing for receiving the light source and an annular channel for guiding the plurality of wires from the light source. The annular adapter includes a first surface, a wall extending orthogonally from the first surface, and a first plurality of tabs extending from the first surface generally parallel to the wall. The plurality of wires are operatively disposed between the first plurality of tabs and the wall.

The adapter further includes a pair of fingers extending from the surface for receiving a sound producing device and a second plurality of tabs extending from the wall. The plurality of wires electrically couple the light source to the sound producing device. The second plurality of tabs are configured to engage the cylinder guard.

DETAILED DESCRIPTION OF THE DRAWINGS

Figures 1, 2:
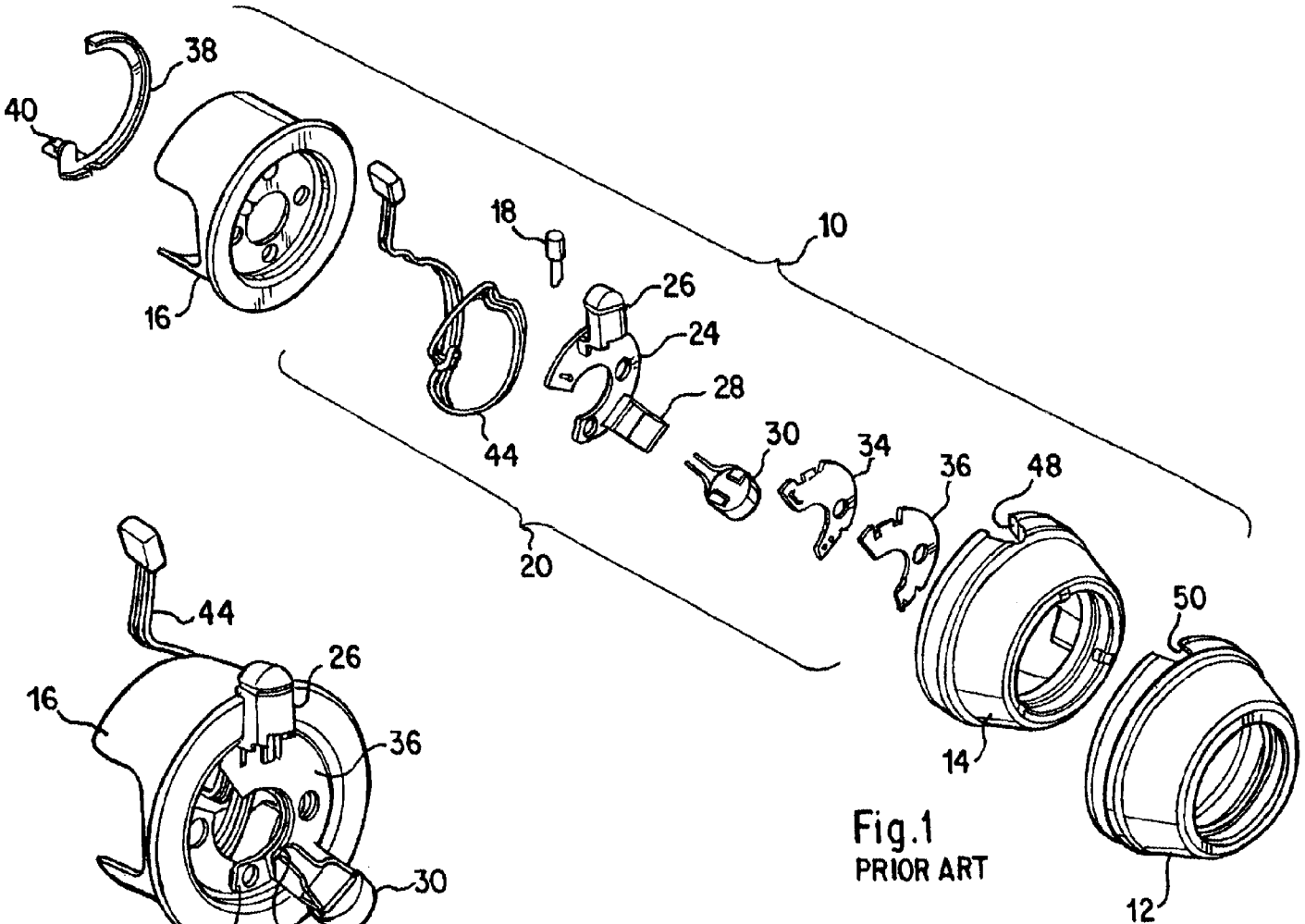
Fig.1 PRIOR ART
Fig. 2 PRIOR ART
FIG. 1 is an exploded view of an existing lighted deadbolt.
FIG. 2 is a view of the light source and wiring harness of FIG. 1 attached to the shield of the deadbolt.

The conventional lighted deadbolt 10 illustrated in FIG. 1 includes a cover 12, a cylinder guard 14, a lock cylinder (not shown), a shield 16, and an LED 18 with a wiring harness 20. The wiring harness 20 includes a support plate 24 with a housing 26 for receiving the LED 18 and a mounting flange 28 for receiving a buzzer 30. A circuit board 34 is mounted to the support plate 24 and electrically connects the LED 18 and buzzer 30. A protective cover 36 is mounted on the circuit board 34. The wiring 44 passes through the shield 16 to meet a semi-circular wire guide 38. The wiring guide 38 includes a channel 40 extending axially from the plane of the guide 38 and directs the wiring 44 radially around the periphery of the shield 16 and axially away from the LED 18. The wire guide 38 is heat swaged to the protective cover 36 through the shield 16 to retain the LED 18 and wiring harness 20 in place on the shield 16. With the LED and wiring harness in place, the shield 16 is installed in the guard 14 so that the LED fits in a notches 48, 50 formed in the guard 14 and cover 12, respectively.

As is apparent from the foregoing, conventional lighted deadbolts require a large number of parts that must be properly aligned and connected during manufacturing and a large number of manufacturing steps to assemble.

Figures 3, 4:
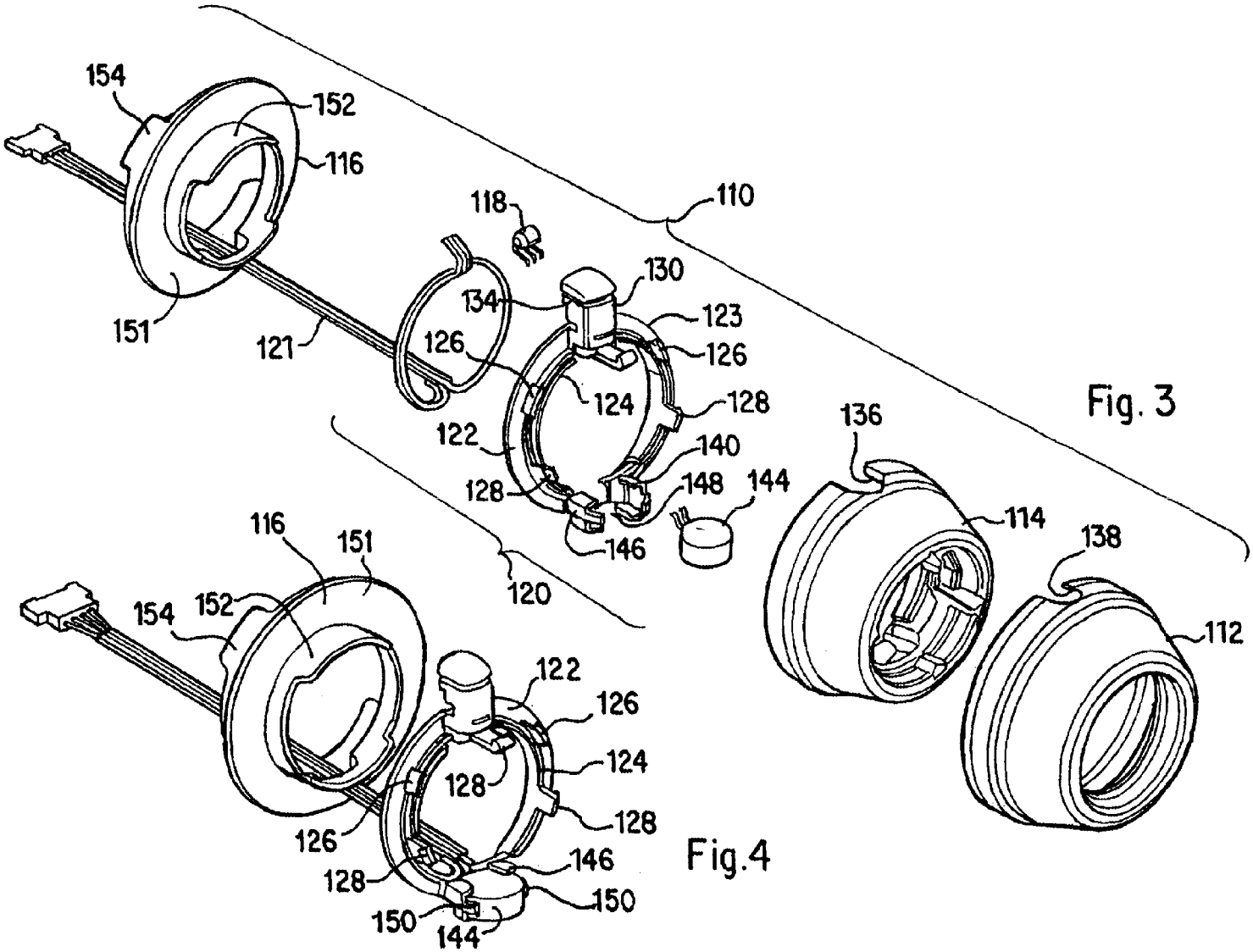
FIG. 3 is an exploded view of a lighted deadbolt according to the present invention.
FIG. 4 is a view of the light source and wiring harness of FIG. 3 attached to the shield of the deadbolt.

A new lighted deadbolt 110 according to the present invention is illustrated in FIGS. 3–4. The deadbolt 110 includes a cover 112, a cylinder guard 114, a lock cylinder (not shown), a shield 116, and an LED 118 with a wiring harness 120. The wiring harness 120 includes wires 121, an adapter 123 having an annular plate 122 and a wall 124 extending orthogonally from the plate 122. The adapter includes a housing for receiving the light source and a circular channel for guiding the plurality of wires from the light source. The channel is defined by the wall 124 and a plurality of retaining tabs 126 extending from the plate 122 parallel to the wall 124. A plurality of snap tabs 128 extend outwardly from the edge of the wall 124 away from the plate 122. A semi-circular LED housing 130 extends radially outwardly from the plate 122 and wall 124. The housing 130 includes a groove 134 for engaging notches 136, 138 in the cylinder guard 114 and cover 112, respectively. A support bracket 140 for receiving a buzzer 144 extends axially from the plate 122 and includes a semi-circular sidewall 146 and a bottom wall 148. A pair of fingers 150 extend from the sidewall 146 to engage and retain the buzzer 144 in the bracket 140.

The LED 118, wires 121 and buzzer 144 are assembled with the adapter 123 as illustrated in FIG. 4. The LED 118 is disposed in the housing 130 and the buzzer 144 is disposed in the support bracket 140, with the LED 118 and buzzer 144 connected to the wires 121. The wires 121 are routed around the annular plate 122 between the wall 124 and the retaining tabs 126. The wires 121 extend from the adapter 123 and are routed through the shield 116 for connection to a power source. The adapter 123 is then in position to be snap-fitted into the cylinder guard 114, with the LED housing 130 disposed in the notches 136, 138 and the snap tabs 128 having orthogonal fingers at their ends engaging the interior surface of the guard 114.

In a preferred embodiment of the invention, the shield 116 includes a base plate 151, a first annular flange 152 extending from one side of the base plate 150, and a second annular flange 154 extending from the other side of the base plate 150. The first annular flange 152 is sized to fit in a standard 1½ inch hole with the adapter 123 disposed around the outside of the flange 152. The second annular flange 154 is sized to fit in a standard 2⅛ inch hole with the adapter 123 disposed inside the flange 154. As illustrated in FIGS. 3–4, the shield 116 is disposed to fit the 1½ inch door prep. To fit the 2⅛ inch door prep, the shield 116 is merely turned around and the wire 121 passed therethrough from the other direction.

The above-described embodiments, of course, are not to be construed as limiting the breadth of the present invention.

Modifications and other alternative constructions will be apparent which are within the spirit and scope of the invention as defined in the appended claims. For example, the above-described embodiments refer to LEDs, but it will be understood by one of ordinary skill in the art that any light source may be used. Likewise, any sound producing mechanism can be used in place of a buzzer.

What is claimed is:

1. A deadbolt having a cylinder guard, the guard having a notch for receiving a light source and exposing the light source to external viewing, the deadbolt comprising:

a light assembly including a light source;

a wiring harness including a plurality of wires electrically connected to the light source; and an annular adapter, the adapter including a housing for receiving the light source, resilient means for attaching the adapter to the cylinder guard, and a circular channel for guiding the plurality of wires from the light source.

2. A deadbolt having a cylinder guard, the guard having a notch for receiving a light source and exposing the light source to external viewing, the deadbolt comprising:

a light assembly including a light source;

a wiring harness including a plurality of wires electrically connected to the light source;

an annular adapter, the adapter including a housing for receiving the light source and a circular channel for guiding the plurality of wires from the light source; and a reversible shield coupled to the cylinder guard, the shield being configured for use on doors having holes with one of two predetermined diameters.

3. The deadbolt of claim 2 wherein the shield includes a first side, a second side, a first circular flange extending from the first side and a second circular flange extending from the second side, the first circular flange being disposed inside the annular adapter when the shield is configured for use on a door having a hole with a first diameter and the annular adapter being disposed inside the second circular flange when the shield is configured for use on a door having a hole with a second diameter.

4. A deadbolt having a cylinder guard, the guard having a notch for receiving a light source and exposing the light source to external viewing, the deadbolt comprising:

a light assembly including a light source;

a wiring harness including a plurality of wires electrically connected to the light source; and an annular adapter, the adapter including a housing for receiving the light source, a circular channel for guiding the plurality of wires from the light source, a first surface, a wall extending orthogonally from the first surface, and a plurality of tabs extending from the first surface in a generally parallel relation to the wall, the plurality of wires being operatively disposed between the plurality of tabs and the wall.

5. The deadbolt of claim 4 wherein the adapter further includes a pair of fingers extending from the surface for receiving a sound producing device.

6. The deadbolt of claim 5 wherein the plurality of wires electrically couple the light source to the sound producing device.

7. The deadbolt of claim 4 wherein the resilient means for attaching includes a plurality of tabs extending from the wall, the tabs being configured to engage the cylinder guard.

8. A deadbolt comprising a light assembly including a light source;

a wiring harness including a plurality of wires electrically connected to the light source and an annular adapter for receiving the light source and guiding the plurality of wires from the light source; and a reversible shield coupled to a cylinder guard, the shield being configured for use on doors having a hole with one of a first diameter and a second diameter.

9. The deadbolt of claim 8 wherein the shield includes a first side, a second side, a first circular flange extending from the first side and a second circular flange extending from the second side.

10. The deadbolt of claim 9 wherein the first circular flange is disposed inside the annular adapter when the shield is configured for use on a door having a hole with the first diameter and the annular adapter being disposed inside the second circular flange when the shield is configured for use on a door having a hole with the second diameter.

11. The deadbolt of claim 8 wherein the adapter includes a first surface, a wall extending orthogonally from the first surface, and a plurality of tabs extending from the first surface.

12. The deadbolt of claim 11 wherein the adapter further includes a pair of fingers extending from the surface for receiving a sound producing device.

13. The deadbolt of claim 8 wherein the adapter further includes a wall and a plurality of tabs extending from the wall, the tabs being configured to engage a cylinder guard.

14. A deadbolt comprising a lock cylinder guard;

a light assembly including a light source; and a wiring harness including a plurality of wires electrically connected to the light source and an annular adapter for receiving the light source and guiding the plurality of wires from the light source, the annular adapter including a plurality of tabs for coupling the adapter to the lock cylinder guard, each tab including a finger extending orthogonally from the tab to engage the lock cylinder guard.

* * * * *